United States Patent [19]

Linka et al.

[11] Patent Number: 4,817,680

[45] Date of Patent: Apr. 4, 1989

[54] METHOD AND SYSTEM FOR INTRODUCING A WEFT THREAD OF FINITE LENGTH IN A STORAGE SHUTTLE OF A WEAVING LOOM

[75] Inventors: Adolf Linka; Franz Lanthaler, both of Hechingen/Bechtoldsweiler, Fed. Rep. of Germany

[73] Assignee: Lindauer Dornier Gesellschaft m.b.H., Lindau/Bodensee, Fed. Rep. of Germany

[21] Appl. No.: 146,263

[22] Filed: Jan. 20, 1988

[30] Foreign Application Priority Data

May 12, 1987 [DE] Fed. Rep. of Germany ..... 3715742

[51] Int. Cl.[4] ..... D03D 47/26

[52] U.S. Cl. ..... 139/436; 139/196.3; 139/224 R

[58] Field of Search ..... 139/13 R, 436, 196.3, 139/224 R

[56] References Cited

U.S. PATENT DOCUMENTS

| | | | |
|---|---|---|---|
| 3,379,224 | 4/1968 | Fend et al. | 139/224 R |
| 3,618,640 | 11/1971 | Linka . | |
| 3,626,990 | 12/1971 | Linka . | |
| 3,749,135 | 7/1973 | Linka . | |
| 4,194,539 | 3/1980 | Griffith | 139/196.3 |
| 4,207,926 | 6/1980 | Sepavich | 139/196.3 |
| 4,410,017 | 10/1983 | Linka | 139/436 |

FOREIGN PATENT DOCUMENTS

| | | |
|---|---|---|
| 83864 | 5/1955 | Czechoslovakia . |
| 3346030 | 6/1985 | Fed. Rep. of Germany . |
| 1066958 | 10/1959 | German Democratic Rep. . |
| 1287526 | 1/1969 | German Democratic Rep. . |

*Primary Examiner*—Henry S. Jaudon

*Attorney, Agent, or Firm*—Frishauf, Holtz, Goodman & Woodward

[57] ABSTRACT

To introduce weft threads (31) or picks of finite length into a storage shuttle (1), the shuttle is formed with a longitudinal recess (4) which is divided into two chambers (11, 12) by a longitudinally extending separating wall (8) leaving a gap (10) between the bottom edge of the separating wall and the bottom wall (6) of the recess (4). Bristles or hairs extend preferably from both sides of the separating wall (8) towards the opposite wall (5, 5') defining the recess (4). A weft thread injector (2) is positioned to engage into the first chamber (11) to pneumatically inject the weft thread into the first chamber, to be retained in undulating or zig-zag pattern in the first chamber. Air is deflected by 180° around the gap (10) and exhausted at an exhaust opening (14) leading from the second chamber (12). Preferably, a thread brake (19) is located at the trailing end of the shuttle, in the direction of relative movement between the shuttle and the injector to clamp the end of the injected weft thread.

21 Claims, 2 Drawing Sheets

METHOD AND SYSTEM FOR INTRODUCING A WEFT THREAD OF FINITE LENGTH IN A STORAGE SHUTTLE OF A WEAVING LOOM

Reference to related patents, the disclosure of which is hereby incorporated by reference:

U.S. Pat. No. 3,049,155

U.S. Pat. No. 3,618,640

U.S. Pat. No. 3,626,990

U.S. Pat. No. 3,749,135.

Reference to related disclosures, illustrating the state of the art: German Patent Disclosure Document DE-OS No. 33 46 030, Czechoslovakian Pat. No. 83,864, German Pat. No. 1,066,958, German Pat. No. 1,287,526.

Reference to related applications, the disclosure of which is hereby incorporated by reference, and assigned to the assignee of this application:

U.S. Ser. No. 07/123,376, filed Nov. 20, 1987, LINKA

U.S. Ser. No. 07/131,637, filed Dec. 11, 1987, LINKA et al

U.S. Ser. No. 07/163,619, filed Mar. 3, 1987, LINKA et al

U.S. Ser. No. 07/123,597, filed Nov. 20, 1987, LINKA.

The present invention relates to introducing and storing a weft thread of finite length in the storage compartment of a shuttle of a weaving loom by use of a compressed air jet, and more particularly to an arrangement and a method to so introduce a sharply defined air jet and, during introduction of the weft thread, relative movement between the air jet and the shuttle in a direction transverse to the air jet may occur.

BACKGROUND

Weaving looms in which a plurality of shuttles are moved through progressive sheds are well known; it is also known to introduce weft threads into continuously moving shuttles of a multi-feed or multi-system weaving loom by means of compressed air, introduced through an injector nozzle. A weft thread introduced through an injector nozzle sometimes will be placed in a weft thread storage area of the shuttle in the form of more or less ordered loops or other configurations. As the weft thread is pulled out of the storage area, the individual loops, which may be kinked, may pull against each other, hook against each other, or otherwise interfere with smooth pay-out, thus preventing orderly and proper placement of the weft thread into the shed of the fabric to be made. It has been proposed to form cross walls, located transverse to a central plane of the shuttle in order to subdivide the storage area into a plurality of communicating chambers. The shuttle is guided in a path past the air ejection nozzle of the weft thread injector, and the intention is a uniform distribution of the weft thread in separate loops, distributed in the respective chambers.

It has been found necessary to place the chambers spaced from each other; they cannot be made as small as would be desirable due to aerodynamic considerations; nor can they be placed as closely against each other as might be desirable. Thus, the shuttle will have a comparatively large overall length which cannot be decreased. This, however, is undesirable since the length of the shuttles decreases the number of sheds which can be formed, so that the speed of the weaving loom is decreased. If the shuttles are shorter, a larger number of shuttles can be accomodated in a given width of the warp threads. With shorter shuttles, and at the same operating speed of the shuttles, a larger number of weft threads can be introduced between the warp threads to more rapidly form fabric, so that the overall operating speed of the weaving loom is increased.

Sequentially located single chambers of shuttles of the prior art are open at their bottom, in order to permit the compressed air from the injector to be injected and then ejected without interference. The bottom opening, typically, is opposite the injector nozzles. Excessive lengths of weft thread, however, which may place themselves in the respective chambers must be prevented, however, from entering the opening in the bottom of the chamber. Such lengths, usually in the form of projecting loops, may catch on the shuttle path guide elements, or otherwise interfere with proper weaving. It has been proposed to form the bottom of the shuttle as a perforated region with comparatively small openings. This prevents weft threads from entering the openings but, on the other hand, is less effective since, if the openings are small enough to prevent the formation of weft thread loops, they have the tendency to become plugged by fluff or the like, even after some comparatively short operating time. In any event, they must be carefully cleaned at regular intervals which, of course, requires stopping of the weaving operation of the weaving loom.

THE INVENTION

It is an object to provide a method and a system carrying out the method to permit constructing shuttles in a more compact manner, by providing compact shuttle thread storage magazines or storage areas, in which the shuttles are so constructed that undesired collection of fluff or contaminants is avoided, while permitting excellent air flow and thus proper placement of weft thread in the storage area, without tendency to loop or hook into each other.

Briefly, the jet is guided into a pair of chambers located in a recess in the shuttle. The chambers are so positioned in the shuttle that they extend lengthwise of the shuttle adjacent each other, and separated from each other by a separating wall or the like extending along the longitudinal dimension, for example a longitudinal axis of the shuttle. The chambers are in communication with each other in the region of the bottom of the chambers, for example by an opening formed in the longitudinal wall. The air from the jet, thus, is guided essentially in a generally U-shaped path, from the top into one chamber, around the communicating portion of the wall, and out in reverse direction from the other chamber. The thread is separated from the jet in the chamber which is first exposed to the jet, to thereby define a thread storage chamber. It is located in the thread storage chamber in a zig-zag or meander-shaped path along the length of the storage chamber. The air from the jet is exhausted through the second chamber, deflected at the bottom of the separating wall by about 180°.

The separating wall preferably has laterally projecting bristles, plush fabric, elastic hairs or projections, closely spaced from each other secured thereto.

The air jet, preferably, is guided or directed through the region of bristles or hairs which are located at least in the thread storage chamber into which the thread is to be introduced. The air can pass through the gap forming the opening in the separating wall adjacent the bottom of the shuttle and out of the second chamber.

The arrangement has the advantage that no constriction or the like need be placed in the path of the air flow through the U-shaped shuttle recess. Rather, air injected by the injector can leave the second chamber throughout the length of the shuttle. Thus, the problem of stopping up of air ducts or plugging of air ducts or the like by collection of fluff is eliminated. The air jet which introduces the weft thread or pick in the first chamber blows through both chambers. It therefore causes continuous cleaning of the chambers, keeping them free from fluff, lint, and any other interfering contaminating deposits. The weaving process, that is, introduction of the pick, is not impeded, since the the pick is loaded into the shuttle outside of the shed. To prevent particles of fluff or lint from reaching the atmosphere, the shuttle, in accordance with a feature of the invention, may include fluff or lint filter material which is located in the second chamber, and which reliably prevents contamination of the air surrounding the weaving loom. Such a lint filter may be formed, for example, by further bristles located in the second chamber, or by an external filter.

The method and the new shuttle arrangement permit constructing shuttles of substantially shorter length than heretofore used for an equal length of weft thread, hence permits operation at a higher speed than previously possible; or, alternatively, the production of wider fabric in the same unit of time. It has been found that the weft thread which is ejected from the pneumatic ejector has a flutter movement, similar to a flag which is extended in the wind. Upon relative movement between the shuttle and the injector, which, typically, means a guidance of the shuttle rapidly in front of the injector nozzle, provides for continuous introduction of the weft thread in the first chamber in accordance with the respective relative speed of movement. Yet, the thread is introduced into the first chamber in zig-zag or meander shape at a speed which is substantially slower than the air speed of the jet. The thread is held against a wall of the storage chamber by the bristles or hairs on the opposite wall. The density of the placement of the bristles or hairs, as well as the respective length of the bristles or hair, and the construction of the shuttles themselves must be matched to the particular thread material which is to be used, considering the characteristics of the thread, e.g. thickness of thread, stiffness, or whether the weft thread is made of worsted yarn, carded, or has other and different surface characteristics.

Preferably, the bristles or hairs extend essentially over the entire width of the first chamber and, again preferably, are secured to the separating wall. The separating wall may be removably secured in the shuttle, so that separating walls with different bristles or hairs, of different lengths, heights, or bending characteristics, can be introduced into the shuttle as desired, so that respective characteristics of threads or yarn to be used can be readily matched to the appropriate bristle or hair characteristics while, also, permitting easy cleaning, if desired.

DRAWINGS

DETAILED DESCRIPTION

Figure 1:
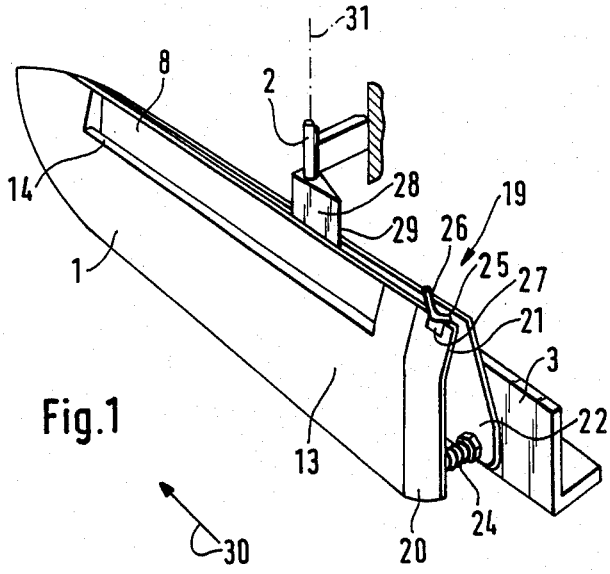
FIG. 1 is a schematic perspective view of a shuttle in accordance with the present invention.

FIG. 1 illustrates a shuttle 1 into which a thread 31 cut to a predetermined length is to be injected by a pneumatic injector 2. The pneumatic injector 2 may be of any suitable construction, receiving compressed air in timed pulses as a thread 31 is introduced into the injector 2 and a shuttle passes in front of the injector. The injector is secured to a fixed portion of the weaving loom frame. The shuttle is moved in a predetermined path by a shuttle drive element or traveler 3. The traveler 3 and the shuttle 1 are magnetically coupled together, to permit passage of warp threads between the shuttle and the traveler when the shuttle enters the shed; this system is well known and reference may be made, for example, the referenced U.S. Pat. No. 3,626,990, by the inventor hereof, for a more detailed discussion.

The shuttle 1 is elongated; preferably, it is made of plastic material, and has magnetic inserts at a side facing the traveler 3 for magnetic coupling with the traveler 3. In longitudinal direction, it is shaped to form a narrow recess 4 (FIG. 4) of essentially U-shaped cross section. The recess 4 is defined by two parallel, flat and preferably smooth inner walls 5, 5', connected together by an essentially semicircularly curved smooth bottom wall 6. The wall at the end portion of the recess 4 in the shuttle is formed with grooves 7, 7'; into which a flat separating wall 8 is fitted. The separating wall 8 is sealed in the grooves, and so placed in the shuttle body that the lower edge of the separating wall 8 is spaced from the bottom wall 6 of the chamber to define a slit-like gap 10 at the base of the recess 4. The gap 10 extends throughout the length of the chamber 4, and subdivides the recess 4 into two adjacent chamber portions 11, 12. Chamber 11, also referred to as a chamber portion, forms a thread storage chamber, to store a pick. In the direction of air flow, it is the first chamber. The upper edge of the separating wall 8 is flush with the upper edge of the shuttle which, when under the injector (see FIG. 4) is close to the injector. The chamber 11 is defined by two side walls of similar height. The side wall 5' of the second chamber 12 has a lesser height than the height of the separating wall 8, so that the second chamber 12 is of lesser depth dimension than the chamber 11. The space between the separating wall 8 and the upper edge of the wall 5' leaves a wide opening 14, formed by the wall body portion 13 and the separating wall 8 and leading out of the second chamber portion 12. The end portion of the second chamber portion 12 forms an air exit opening to permit air used during injection of a thread to be ejected from the recess 4.

Elastic hairs or bristles 16 are secured to the separating wall 8, and extend into the first chamber portion 11 within a region 15. The hairs or bristles extend transversely to the longitudinal direction of the shuttle, that is, transversely to the separating wall 8. They are securely connected to the separating wall 8 and are closely located adjacent each other. The hairs or bristles 16 extend, essentially, over the entire width of the first chamber portion 11. The spacing of their ends from the smooth wall 5 of the shuttle body, as well as the thickness and density of the hairs or bristles 16 depend on the characteristics of the weft thread or weft yarn material to be stored within the shuttle.

The second chamber portion 12 also retains a region 17 with hairs or bristles, in which the hairs or bristles 18 are secured to the separating wall 8, extending in opposite direction, however, from the hairs or bristles 16. These hairs or bristles 18 terminate in a somewhat greater distance from the wall 5' of the body portion 13, which is smooth. Also, it is desirable to space the individual bristles or hairs 17 from each other so that the bristly or hairy region is less dense than the bristly or hairy region 15 in the first chamber portion 11. Both bristly or hairy regions 15, 17 extend over essentially the entire length of the recess 4 of the shuttle and along the major portion of the height of the separating wall where it is located within the respective chamber portion 11, 12, and preferably to the lower edge of the separating wall 8.

Figure 2:
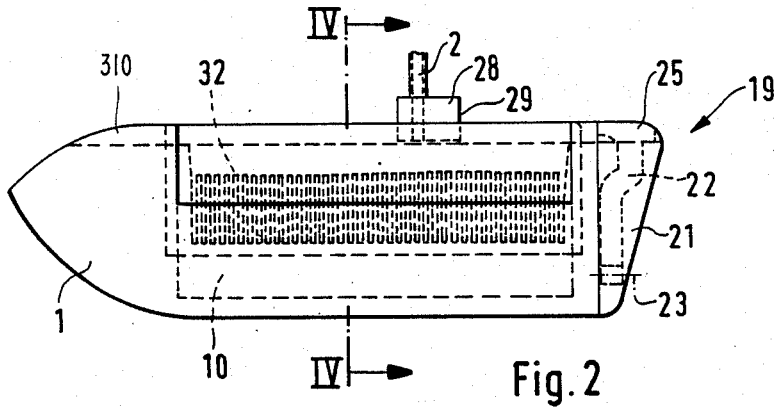
FIG. 2 is a side view of the shuttle.
Figure 3:
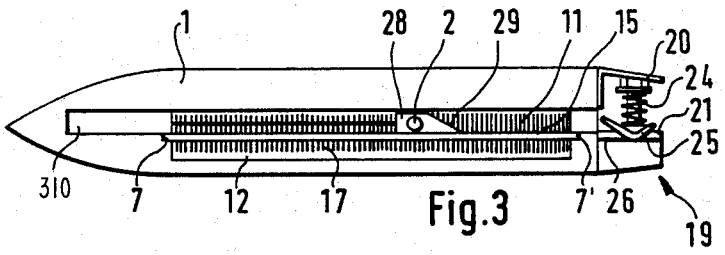
FIG. 3 is a top view of the shuttle.

A thread brake 15 is located at the trailing end of the shuttle, located in a housing 20, 21 secured to or forming part of the rear wall of the shuttle body 1. A longitudinally extending wall portion 21, in alignment with the separating wall 8, carries a fixed brake surface, which is in operative association with a resiliently movable brake flap 22 (FIG. 2). Flap 22 can move transversely with respect to the longitudinal direction of the shuttle, by being pivotably secured in the shuttle body 1 by a pivot 23 (only seen in FIG. 2), so that it may pivot about an axis extending in the longitudinal direction of the shuttle. A spring 24 elastically engages the brake flap 22 against the brake surface on the wall extension 21. The upper end portion 25 of the flap 22, in cross section, is essentially T-shaped; the leg 26 of the T-shaped end facing the recess 4 forms an acute angle with the adjacent wall extension 21, as seen in FIG. 3 defining a ridge. The wall extension 21 is formed with a groove, or a depression, or a recess 27, in which the ridge of the bent or curved cross element of the T-shaped flap 22 can engage, see FIG. 3, in which the peak or ridge region thereof is received in the groove, depression, or recess 27. The T-shaped end portion of the brake flap 22 as shown engages in an opening 27 formed in the wall extension portion 21. The externally facing edge portions of the brake surface form retention regions for a weft thread in the shuttle. The retention regions, formed by surfaces of the T-shaped upper portion 25 of flap 22 and adjacent regions of the wall extension 21 are preferably slightly roughened, hardened, or coated with a wear-resistant coating material.

An operating element 28 for the brake 19 is located on the injector 2. This operating element is essentially wedge-shaped, as best seen in FIGS. 1 and 3. The leading edge 29 of the wedge-shaped operating element is directed towards the brake 19 and is so positioned and angled that the brake 19 can be opened as the shuttle passes beneath the injector for introduction of a pick, or weft thread or yarn therein by engaging against the angled leg 26 of the T-shaped end 25 and wedging it away from wall 21.

OPERATION

INSERTION OF A WEFT THREAD

The shuttle 1 is moved in the direction of the arrow 30 (FIG. 1) by being magnetically coupled to the traveler 3. As the shuttle passes the injector 2, secured to a fixed location, the nozzle-like end portion of the injector will enter the first chamber portion 11 up to and immediately adjacent the hairy or bristled region 15. The shuttle, at the leading edge, is formed with an introduction slot 310, extending in longitudinal direction and alignment with the first chamber portion 11 to the forward end of the shuttle (see FIG. 2), so that the injector 2 may freely enter into the first chamber portion 11 of the shuttle 1.

A thread supply apparatus, for example of the type described U.S. Ser. No. 07/163,619 of the cross-referenced patent applications by the inventor hereof, or of any other suitable type, provides a weft thread 31, or pick of suitable length. The weft thread element 31, upon being ejected from the injector nozzle 2, has a tendency to undulate or flutter. Consequently, it will be introduced in the storage region 4, and specifically in the first or storage chamber portion 11 of the shuttle 1 in essentially zig-zag or meander shape as schematically illustrated in FIG. 2 by the meander or zig-zag position of the stored thread 32. The stored thread 32 will be retained by the hairs or bristles in the region 15 of the first chamber portion 11, and the stored thread 32 can extend over the entire region 15 of the hairs or bristles 16. The bristles or hairs 16 which extend across the storage chamber 11 are positioned transversely to the direction of air as it is initially ejected in form of a jet, and also transverse to the relative movement of the shuttle 1 and injector 2. Air, however, can continue to flow through the gap adjacent the bottom wall 6, be deflected by the bottom wall of the chamber 4 by 180°, passed through the communicating gap 10 between the lower edge of the separating wall 8 and the bottom wall 6 of the chamber 4, and enter the second chamber portion 12. The air can then leave through the exit opening 14, unimpeded, throughout the length of the shuttle. Since the exit opening 14 of the second chamber portion 12 extends over the length of the side wall 13, the air being emitted from the exit opening 14 will leave with somewhat of a lateral direction. Any excess length of the weft thread which might occur is retained in the hairy or bristly region 17 of the second chamber 12, so it may not extend through the opening 14.

The shuttle continues to move in front of the injector 2. As the injector 2 reaches the trailing portion of the shuttle, the wedge-shaped edge 29 of the operating element 28 will enter the wedge-shaped gap between the wall extension 21 and the angled-off portion 26 of the T-shaped brake part 25. This causes the brake part or flap 25 to be laterally pivoted while, simultaneously, and as weft thread 31 continues to be fed through the injector, the now spaced brake surfaces can receive the weft thread therebetween. At the same time, the brake surfaces are cleaned by the air still being emitted from the injector 2.

The air supply to the injector 2 is timed. As soon as the shuttle 1 has passed the injector and has left the operating element 28, the brake flap 22 snaps against the housing wall extension 21 under pressure of the spring 24, so that the end portion 25 will fit against the housing wall 21 and resiliently clamp the end region of the pick 31, shown at 32, when stored in the shuttle elastically between the brake parts 25 and 21. The T-shaped end portion 25, then entering the opening 27, reliably prevents random release of the end of the pick or weft thread 31 from the brake 19.

Figure 4:
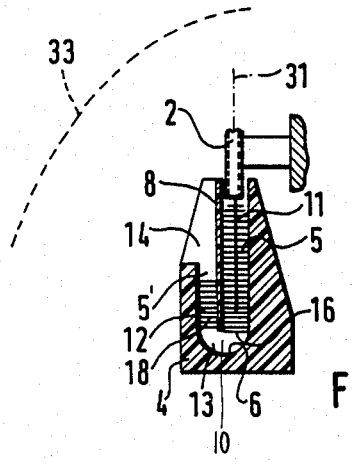
FIG. 4 is a section along line IV—IV of FIG. 2.
Figure 5:
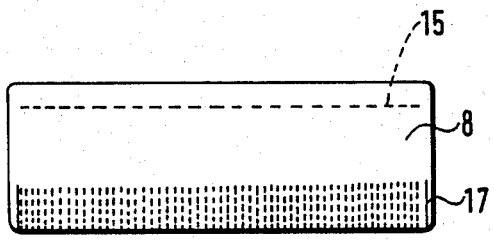
FIG. 5 is a side view of a separating wall element removed from the shuttle.

Fluff, lint, and other contaminants cannot be blown by the air jet from the second chamber 12 into the surrounding atmosphere by placing, as shown in FIG. 4, an external shield filter 33. This filter is not strictly necessary, since the bristles or hairs 17 also retain fluff or lint.

A suitable filter 33 is, for example, a gauze fabric, or similar air pervious lint filter material.

It may occur that the weaving loom, in which the method and the shuttle construction is to be used, is subject to sudden stopping, for example upon response of a "stop motion" device, or other safety apparatus. It has been found by experience that under such conditions the weft thread is not always properly introduced into the shuttle. It may then occur that the weft thead element actually introduced into the shuttle has excess length. Due to the U-shaped formation of the storage chamber for the weft thread, possibly occurring excess lengths will not have undesirable consequences since such excess lengths may merely be stored in the second chamber portion 12, and thus will not leave the shuttle, and thus be introduced into the shed and form an weaving error or defect. Placing the bristly region 17 into the second chamber has the advantage that such possible excess lengths of the weft thread will be reliably retained within the shuttle, rather than hanging out. The hairs or bristles in the region 17 of the second chamber 12 preferably terminate some slight distance before the opposite wall 5' of the chamber 12, and preferably have slightly lesser density, although, for some threads, the same density in the respective chamber portions 11 and 12 may be used.

The extent of the chambers into the shuttle body is preferably identical, which permits use of a single element 8 from which the bristles extend in opposite direction, the separating wall forming the separating element 8 then being inserted in the respective grooves 7, 7' (FIG. 3) of the shuttle body. The shuttle body itself can be symmetrical with respect to the upper edge, that is, it is not necessary to form the wall of the chamber portion 12 with a recess defining the exit opening 14. The two side walls of the shuttle body may have the same height. The recess or opening 14, however, is a preferred construction so that the height dimension of the respective chamber portions 11, 12 will be different. This preferred construction has the advantage that the shuttle is lighter, since less material is used, and will also save material. Additionally, the air ejection relationships are improved since the ejected air will be directed away from the shuttle path.

The application of bristles or hairs on the separating wall 8 in the first chamber portion 11 and, if used, also in the second chamber portion 12, is carried out in any well known and suitable manner. It has been found particularly economically desirable to apply the hairs or bristles by flock coating or dry coating of the separating wall. It is not absolutely necessary that the hairs or bristles extend from the separating wall to the wall surface 5, 5'. The bristles or hairs may also be applied to the shuttle body, if the shuttle body is made, for example, as a composite element. For ease of manufacture, placing the hairs or bristles on the separating wall 8 is preferred. Flock coating of the wall portions 5, 5' is also possible.

The injector 2 preferably cooperates with the shuttle 1 such that it engages within the first chamber portion 11. This reliably eliminates malfunction by confining the air jet from the nozzle of the injector, and prevents unintended deflection of the air jet by a shuttle element.

The thread brake 19 contributes to orderly insertion of the weft thread into the shed of the loom. An elastic friction brake, as described, is particularly suitable. This arrangement also permits easy coordination with the injector 2 by so constructing the friction brake that it is automatically opened by the wedge edge 29, so that the injector itself will form the brake opening element to permit placement of the weft thread in the brake for subsequent clamping therein. The arrangement permits locating the end portion of the injected weft thread close to the trailing end of the shuttle after the insertion. Opening a brake to receive the weft thread is automatic and occurs without further apparatus upon relative movement between the injector and the shuttle. Synchronization, likewise, of movement is automatic. The air jet, being emitted from the nozzle of the injector, cleans the brake surfaces, so that no fluff or lint can deposit thereon.

The arrangement in which a fixed brake surface is located on the shuttle, for cooperation with the movable T-shaped element 22, is particularly simple since only one brake surface has to be movably positioned on the shuttle. Coating the respective braking surfaces with wear-resistant material is particularly desirable if weft threads or yarn are used which are made of man-made material, such as synthetics of various types. The weft thread, upon introduction into the shed, is retained in the brake by the simple retention element of a groove or notch 27, over which the cross element 26 of the T-shaped brake element can engage, the cross element being angled or offset to form a ridge or peak which can engage in the groove or notch 27.

Practical experience has shown that even long weft thread elements can be stored within a short storage region of a shuttle. Tangling of the weft thread, or entangling of elements thereof, for example due to kinking or bunching of weft thread portions, is essentially eliminated. All conditions for reliable weaving and introduction of the weft thread into the shed are therefore obtained.

The invention is applicable for various types of weaving looms, and particularly suitable for weaving looms with continuous movement of the shuttle, for example for back-to-back linear weaving looms with a continuous closed shuttle path, circular weaving looms or the like.

Various changes and modifications may be made within the scope of the inventive concept.

We claim:

1. A method of pneumatically introducing a weft thread or pick (31, 32) into a moving shuttle (1) in which a compressed air jet is emitted from an injector (2) and is utilized to introduce the weft thread or pick into the shuttle, which shuttle moves relative to the injector, wherein, during said introduction, the air of said jet is constrained to follow a path transverse to the direction of relative movement of the shuttle and the injector, comprising, in accordance with the invention, the steps of guiding the air of said jet in a generally U-shaped path, by guiding said air into a first chamber (11) located in the shuttle, then deflecting the air within the shuttle by about 180°, and then, in a reverse direction of air flow, guiding said air into a second chamber (12) located adjacent and parallel to said first chamber, and then exhausting said air, said chambers, extending along the longitudinal direction of the shuttle and being separated from each other by a separating wall leaving a communication gap to provide for air flow communication of said chambers; and separating said weft thread or pick from the air of the jet in the chamber first exposed to the air jet and forming a thread storage chamber (11), and locating the thread within the thread storage chamber along the length of the thread storage chamber by relatively moving the shuttle and the air jet.

2. The method of claim 1, wherein said step of separating the thread from the air jet in the chamber (11) first exposed to the air jet comprises passing the thread, as it is being moved by the air jet, through a region in said first chamber which includes hairs or bristles extending transversely to the relative direction of movement between said air jet and said shuttle.

3. The method of claim 1, wherein the step of emitting the air jet from the injector (2) comprises emitting compressed air from said injector in pulses.

4. A system for pneumatically introducing a weft thread (31) in a storage shuttle (1) in which a compressed air jet is utilized to introduce the weft thread into the shuttle and, upon said introduction, the air of said jet is constrained to follow a path transverse to the initial jet direction, said system having an injector (2), positioned with respect to the shuttle (1) for placement of the weft thread (31) therein while the shuttle and the injector move relative to each other along a longitudinal direction of the shuttle.

said system comprising, in accordance with the invention, a recess (4) formed within the shuttle and extending essentially longitudinally thereof;

a separating wall separating said recess into two adjacent elongated chambers (11, 12) while leaving a communicating gap (10) between a bottom edge of the separating wall and a bottom wall portion (6) of said recess, said injector (2) having an injection opening directing the air jet into the first chamber (11) to provide for air flow in a generally U-shaped path from the first chamber, deflection by about 180° at the bottom wall of the recess, and exhaust through said second chamber (12);

and hairs or bristles (16) located at least in the first chamber (11) and forming a hairy or bristled region therein, with the hairs or bristles extending essentially transversely to the original direction of the air jet from said injector, said hairs or bristles being located close to each other and being resiliently deflectable from said essentially transverse direction.

5. System according to claim 4, further including a second region of hairs or bristles (18) located in the second chamber;

and wherein said hairs or bristles extend in a direction between said separating wall and a facing wall portion (5') of the second chamber, and the length of said hairs or bristles are less than the spacing between said separating wall and said facing wall portion.

6. System according to claim 5, wherein the densities of the hairy or bristled regions (15, 17) in the respective first and second chambers are different.

7. System according to claim 4, wherein the hairs or bristles (16) are secured to the separating wall.

8. System according to claim 5, wherein the hairs or bristles (16) are secured to the separating wall.

9. System according to claim 4, wherein the length of the hairs or bristles corresponds approximately to the spacing between the separating wall (8) and the immediately opposite facing wall portion (5) of the shuttle.

10. System according to claim 7, wherein the length of the hairs or bristles corresponds approximately to the spacing between the separating wall (8) and the immediately opposite facing wall portion (5) of the shuttle.

11. System according to claim 4, wherein said separating wall (8) is removably inserted in the shuttle (1).

12. System according to claim 4, wherein the depth dimension of the second chamber (12) is less than the depth dimension of the first chamber (11).

13. System according to claim 4, wherein the injector is positioned relative to the shuttle to penetrate with an end portion of the injector into an upper region of the first chamber (11).

14. System according to claim 4, wherein the hairs or bristles retained in the chamber (11) are attached to the next adjacent wall defining the chamber by flock coating or dry coating of said next adjacent wall.

15. System according to claim 4, further including a thread brake (19) located longitudinally adjacent said chambers (11, 12), said thread brake having a pair of elastically biassed brake surfaces, a transversely movable element (22) carrying one of said surfaces, said transversely movable element being positioned on the shuttle for engagement by the injector (2) for, respectively, engaging or disengaging said thread brake.

16. System according to claim 15, wherein said injector includes a brake operating element (28) of essentially wedge-shaped form and terminating in a separating edge (29) which, upon relative movement of the shuttle and the injector, tends to separate said brake surfaces and move the transversely movable element (22) out of engagement with a cooperating brake surface on the shuttle.

17. System according to claim 15, wherein one of said brake surfaces is rigidly secured to the shuttle.

18. System according to claim 15, wherein said brake surfaces include surfaces of wear-resistant material.

19. System according to claim 15, wherein at least an externally facing edge portion of the brake surfaces includes retention means (25, 26, 27) for the inserted thread (31).

20. System according to claim 19, wherein the retention means comprise a recess or notch formed in one of the brake surfaces, and a projecting or extending portion formed in the other of the brake surfaces, engageable with the recess or notch.

21. System according to claim 4, for storing a pick of finite length, wherein said shuttle is formed with a wall portion (13) in part defining said second chamber, said wall portion being formed with a longitudinal recess (14) to cause said second chamber (12) to have a lesser depth than said first chamber (11) and provide an air exhaust or ejection opening extending essentially along the longitudinal dimension of the shuttle; and further including stationary fluff or lint filter means (33) located externally of the shuttle and adjacent said air exhaust or ejection opening (16).

* * * * *